United States Patent [19]

Cohen

[11] 4,155,002

[45] May 15, 1979

[54] GOLF BALL HEATING DEVICE

[76] Inventor: Wilburt Cohen, 2444 Hunterbrook Rd., Yorktown Heights, N.Y. 10598

[21] Appl. No.: 802,563

[22] Filed: Jun. 1, 1977

[51] Int. Cl.[2] ..... H05B 3/06

[52] U.S. Cl. ..... 219/521; 150/1.5 R; 150/52 A; 206/315 B; 219/386; 219/535; 273/62; 312/49

[58] Field of Search ..... 219/219, 385, 386, 387, 219/437, 439, 521, 524, 525, 528, 530, 533, 535, 540; 150/1.5 R, 1.5 B, 1.5 C, 52 A; 273/62, 32 D; 206/315 R, 315 B; 338/302; 312/49; 221/297

[56] References Cited

U.S. PATENT DOCUMENTS

| | | | |
|---|---|---|---|
| 1,829,093 | 10/1931 | Hollins | 150/1.5 C |
| 2,664,933 | 1/1954 | Gielow | 150/1.5 C |
| 3,275,803 | 9/1966 | True | 219/535 |
| 3,497,676 | 2/1970 | Gravatt | 219/521 |
| 3,519,023 | 7/1970 | Burns, Sr. et al. | 219/535 X |
| 3,683,155 | 8/1972 | Loffbourow | 219/521 |
| 3,756,299 | 9/1973 | Simmons | 150/1.5 C X |
| 3,800,981 | 4/1974 | Zeller | 206/315 X |
| 3,828,165 | 8/1974 | Collins | 219/521 |
| 3,831,001 | 8/1974 | Toomey et al. | 219/386 |

*Primary Examiner*—Volodymyr Y. Mayewsky
*Attorney, Agent, or Firm*—Pennie & Edmonds

[57] ABSTRACT

A device for maintaining heated golf balls at an elevated temperature under playing conditions is desired. A heated container is provided with dividing means, such as a moveable wall, which may be operated during removal of a selected heated ball so as to seal off the remaining heated balls from the ambient air, thereby maintaining them at the elevated temperature.

8 Claims, 3 Drawing Figures

GOLF BALL HEATING DEVICE

BACKGROUND OF THE INVENTION

1. Field of Use

This invention relates to the heating of golf balls so as to increase the distance which they will travel when struck with a golf club. It is known that a golf ball which is slowly and uniformly heated to a temperature of approximately 104°-120° F. will demonstrate a maximum increase in distance over an unheated ball. Heating to temperatures above approximately 125° F. will lead to deterioration of the golf ball. Conversely, a decline in the golf ball temperature from the optimum elevated temperature, such as may occur under playing conditions, decreases the extra distance which the golf ball will travel. It is therefore desirable to have a device which will not only heat the golf balls to the optimum temperature but which will also maintain them at or near that temperature under playing conditions.

2. Prior Art

Several prior art devices have been employed for the purpose of heating golf balls. However, in each case, opening of the heated container to remove a selected ball simultaneously exposes all of the remaining balls to the ambient air, therefore making it difficult to maintain the remaining balls at the elevated temperature.

For example both U.S. Pat. Nos. 3,683,155 (Loofbourow 1972) and 3,831,001 (Toomey et al. 1974) essentially involve placement of the golf balls in a tray situated beneath a removable cover. When the cover is removed in order to select a ball, all of the remaining balls are simultaneously exposed to the ambient air. Similarly, U.S. Pat. No. 3,497,676 (Gravatt 1970) involves placement of the golf balls between two folding hinged elements, rather like an egg carton. Once again, opening the elements exposes all of the balls inside to the ambient air simultaneously.

Finally, U.S. Pat. No. 3,828,165 (Collins 1974) involves placing the golf balls in cylindrical tubes heated by the motive system of a golf cart. When the plug at the open end of the tube is removed in the course of extracting a selected ball, the remaining balls are exposed to the outside air. Although this reference does address the problem of maintaining the golf balls at the elevated temperature under playing conditions, the solution devised is continual heating by the motive system of the golf cart rather than, as in the present invention, restriction of contact with the ambient air. Moreover, the Collins device is obviously dependent on the use of a golf cart and would therefore be unsuitable for the golfer who does not use such a cart or else desires a more portable apparatus.

Thus, none of these prior devices discloses the concept of maintaining the golf balls at the elevated temperature under playing conditions by restricting contact between the remaining balls and the ambient air during removal of a selected heated golf ball.

SUMMARY OF THE INVENTION

It is therefore the object of this invention to provide a portable container of simplified construction which may be employed to heat golf balls to an optimum elevated temperature and which will then maintain such balls at the elevated temperature under playing conditions by restricting contact between the remaining balls and the ambient air during removal of a selected heated golf ball. More particularly, it is the object of this invention to provide such a container having a means for selectively dividing the interior of the container into at least two separate chambers so as to seal off the remaining balls from the ambient air during removal of a selected ball.

The foregoing and other objects and advantages of this invention will appear from the following detailed description, taken in connection with the accompanying drawings of preferred embodiments.

DETAILED DESCRIPTION OF THE INVENTION

Figure 1:
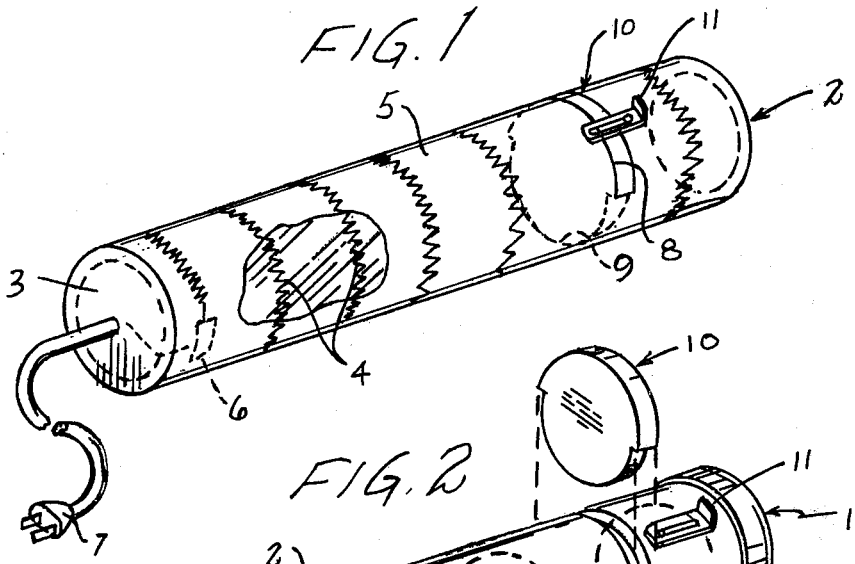
FIG. 1 is a perspective view of the golf ball heating device of the present invention, cut away to disclose the placement of electrical heating coils or elements and a thermostatic control element in the wall of the container.
Figure 2:
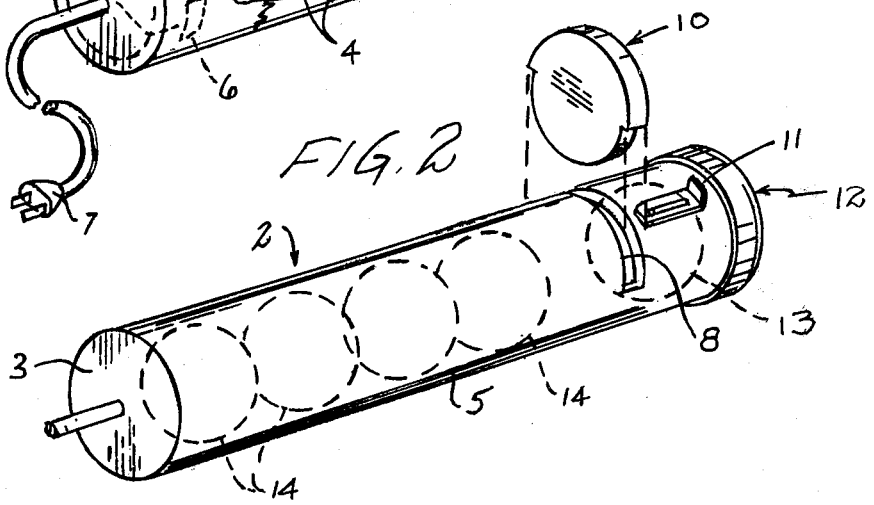
FIG. 2 is a perspective view similar to FIG. 1 showing the placement of the golf balls in the container, the dividing means in the "open" position, and a cap fitted to the open end of the container.
Figure 3:
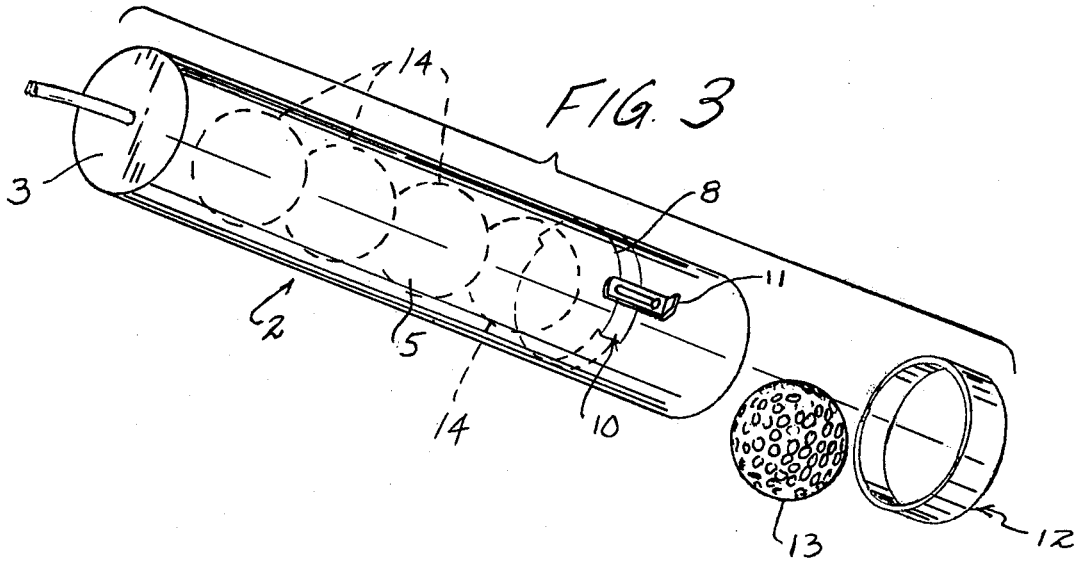
FIG. 3 is a perspective view similar to FIG. 1 showing the placement of the golf balls in the container, the dividing means in the "closed" position, and the cap removed from the open end of the container.

FIGS. 1-3 illustrate the preferred embodiment of the invention. A hollow container 1 is constructed with an open end 2 and a closed end 3. The precise shape of the container is unimportant, and while the spherical shape of the balls makes a container having a circular cross-section the preferred embodiment, the container may also exhibit a square, rectangular, or elliptical cross-section. Similarly, the material or materials used in construction of the container may be varied, although preferably a metal or plastic is desired which will tend to conduct the electrically-generated heat towards the interior of the container while insulating such interior from temperature effects in the ambient air outside the container.

A series of electric heating coils or elements 4 is disposed within and along the wall 5 of the container. The coils are connected through a thermostatic control element 6 and an electric plug 7 to a source of electric power, such as a battery or, preferably, a conventional household current.

The wall 5 contains a slot 8 at a distance from the open end 2 of the container only slightly greater than the diameter of one standard golf ball. As shown in the preferred embodiment of FIGS. 1-3, the slot 8 extends for approximately half the outer circumference of the wall 5 of the container. The slot continues as an interior groove 9 along the inside circumference of the wall of the container. In the event that a container having a rectangular cross-section is employed, the slot need be in only one of the outside walls, with the internal grooves continuing from it along the inside of at least the two walls at right angles to the wall containing the slot.

A means 10 for selectively dividing the hollow interior of the container into at least two separate chambers, such as the moveable wall shown in FIGS. 1-3, is configured to pass through the slot 8 and fit into the interior groove 9. The fit of this dividing means 10 in the interior groove 9 is sufficiently snug so that the dividing means 10 will act as a thermal barrier to restrict the flow of heat between the respective chambers. For this purpose, the dividing means 10 is also fitted with a snap 11 or other device for securing it in place. The dividing means 10 must also be disengageable so as to permit the passage of a single heated golf ball into the chamber between said dividing means and the open end 2 of the container. The dividing means 10 may be of the same or a different material from that used in construction of the remainder of the container, the essential requirement being that it function as a good heat insulator.

The container is further provided with a means 12, such as the cap shown in FIGS. 1-3, for selectively opening and closing the open end 2 of the container so as to provide and to seal, respectively, access to the hollow interior thereof. The opening and closing means 12 may be any kind of closure which may be removably fitted to the open end 2 of the container, such as a cap or a short plug, provided that it does not reduce the distance between the open end 2 of the container and the dividing means 10 beyond the diameter of a standard golf ball. The opening and closing means 12 may again be made of any desired material, provided that such material functions as a good heat insulator.

FIGS. 2 and 3 show the placement of the heated golf balls in the container during operation of the present invention. A selected golf ball 13 has been brought for purposes of removal by the golfer near to the open end 2 of the container, so that it is positioned in the single-ball holding chamber between the dividing means 10 and the opening and closing means 12. The invention permits operating these parts in such manner as to maintain the remaining golf balls 14 at their elevated temperature by preventing contact between them and the ambient air during removal of the selected golf ball 13.

In operation, the invention functions as follows. The golfer initially loads the container with as many unheated golf balls as he desires and as the capacity of the container allows. Since the electric heating coils or elements 4 are disposed along the entire length of the wall 5 of the container, for purposes of initial heating, a golf ball may also be placed in the single-ball holding chamber between the dividing means 10 and the opening and closing means 12. The dividing means 10 is passed through the slot 8 so that it is seated in the interior groove 9. The opening and closing means 12 is then fitted to the open end 2 of the container so as to seal or close it. The electrical plug 7 is then connected to a power source and, under the controlled temperatures maintained by the thermostatic control element 6, the golf balls are allowed to slowly and uniformly warm to a temperature of approximately 104°-120° F. over a period of one, and preferably two, days. Upon attainment of the desired elevated temperature, the golfer disconnects the electric plug 7 from the power source and is able to take the heated container with him to the golf course.

Assuming that a golf ball has been placed in the single-ball holding chamber, and that the dividing means 10 is seated in the interior groove 9 so as to seal off any golf balls in the chamber between such dividing means and the closed end 3 of the container from contact with the ambient air, removal of this first ball may be accomplished without affecting the temperature of any other balls in the container by simply removing the opening and closing means 12 at the open end 2 of the container, extracting the ball, and resealing the open end 2 of the container with the opening and closing means 12. It is in the extraction of additional balls, however, that the invention shows its primary advantage in being able to maintain the remaining golf balls at the elevated temperature.

For purposes of removing such additional balls, the following procedure is used. With the opening and closing means 12 still sealing the open end 2 of the container, the dividing means 10 is moved upward through the slot 8 just far enough to allow the selected ball 13 to be rolled into the single-ball holding chamber. The resulting position of the elements of the invention is depicted in FIG. 2. The dividing means 10 is then returned through the slot 8 so that it is again seated in the interior groove 9, thereby sealing off the remaining balls 14 in the chamber between said dividing means 10 and the closed end 3 of the container. The selected ball 13 is now positioned in the single-ball holding chamber between the dividing means 10 and the opening and closing means 12. At this point the opening and closing means 12 may be removed from the open end 2 of the container, permitting extraction of the selected ball 13 without allowing any ambient air to contact the remaining heated golf balls 15, thereby maintaining them at their elevated temperature. This situation is depicted in FIG. 3. The opening and closing means 12 is then replaced so as to again seal the open end 2 of the container, thereby permitting repitition of the above procedure during the extraction of each of the remaining golf balls.

It will be apparent to those skilled in the art that various changes may be made in the size, shape, number, type, and arrangement of parts described herein without departing from the spirit of this invention.

I claim:

1. A golf ball heating device comprising:

(a) a hollow container;

(b) means for selectively opening and closing an end portion of said container to provide and to seal, respectively, access to the hollow interior thereof;

(c) means for selectively dividing the hollow interior of said container into at least two separate chambers, one of which is dimensioned to hold a single golf ball adjacent to said opening and closing means, said dividing means being disengageable to permit golf ball passage from the other of said chambers into said single-ball holding chamber and which means acts as a thermal barrier to the flow of heat between said chambers;

(d) heating means secured in said container for heating golf balls placed in said hollow interior to a temperature of about 104° to about 120° F.;

(e) means for insulating said container to restrict heat loss therefrom;

whereby said dividing means may be disengaged to pass a single heated golf ball from said other chamber into said single-ball holding chamber and thereafter returned to the dividing position to isolate heated golf balls in said other chamber from ambient temperatures before said opening and closing means is opened for removal of said single heated golf ball from the container.

2. A device in accordance with claim 1 in which said container has a tubular shape and a circular cross-section.

3. A device in accordance with claim 1 in which said dividing means comprises a slot in a wall of said container, said slot being spaced from said end portion by a distance corresponding to said single ball-holding chamber and a moveable wall passing through said slot and seated in an interior groove of said container to establish division of the interior of said container into said separate chambers.

4. A device in accordance with claim 3 in which said moveable wall is made of insulating material to restrict heat transfer between said chambers when said wall is seated in said interior groove and said opening and closing means is open to provide access to said hollow interior of said container.

5. A device in accordance with claim 1 in which said heating means comprises electrical elements disposed and secured in and along the walls of said container and adapted to be energized by an electrical source, and a thermostatic element connected between said source and said coils or elements to control the heating of golf balls placed in said hollow interior by said energized coils or elements.

6. A device in accordance with claim 1 which includes a means for insulating said container to restrict heat loss therefrom while said heated golf balls are disposed therein.

7. A device in accordance with claim 1 which is portable for hand carrying on a golf course.

8. A golf ball heating device comprising:

(a) a hollow container having a closed end, and a slot along a portion of the perimeter of a wall of the container, the ends of said slot being continued by an interior groove along said perimeter on the inside surface of said wall;

(b) a moveable wall which may be passed through said slot and seated in said interior groove so as to divide the interior of the container into two separate chambers and which acts as a thermal barrier to the flow of heat between said chambers;

(c) a closure element in sealing engagement with the open end of the container and which may be removed to provide access to the interior of said container through that end;

(d) a series of heating elements for electrically heating the interior of said container which are disposed and secured in and along the walls of the container;

(e) a thermostatic control element for controlling the amount of heat generated by said heating elements for purposes of heating the golf balls in the interior of said container;

(f) a means for supplying electric power through the thermostatic control element to said heating elements; and (g) a means for insulating said container to restrict heat loss therefrom.

* * * * *